US005319835A

United States Patent [19]

Chao

[11] Patent Number: 5,319,835

[45] Date of Patent: Jun. 14, 1994

[54] CROSSED TYPE DOUBLE-CLAMP CLIP

[76] Inventor: Chung L. Chao, 8F-6, No. 100, Sec. 2, Hoping E. Rd., Taipei, Taiwan

[21] Appl. No.: 107,999

[22] Filed: Aug. 18, 1993

[51] Int. Cl.[5] ..... B42F 1/00

[52] U.S. Cl. ..... 24/67.9; 24/546

[58] Field of Search ..... 24/67.9, 67.3, 67 R, 24/546, 545, 547, 551

[56] References Cited

U.S. PATENT DOCUMENTS

| | | | |
|---|---|---|---|
| 2,908,954 | 10/1959 | Chaun | 24/67.9 |
| 4,170,052 | 10/1979 | Okerblom | 24/67.9 |
| 4,324,025 | 4/1982 | Apri | 24/551 |
| 5,022,124 | 6/1991 | Yiin | 24/67.9 |
| 5,067,205 | 11/1991 | Chen et al. | 24/67.9 |

*Primary Examiner*—Victor N. Sakran

*Attorney, Agent, or Firm*—Browdy and Neimark

[57] ABSTRACT

A crossed type double-clamp clip made by bending an iron wire into shape, having two clamping portions symmetrically disposed below a middle bend thereof and crossed over each other, each clamping portion being made in the configuration of an open loop, whereby the relative positions of the two clamping portions are adjusted according to the thickness of the stack of paper onto which the two clamping portions are clamped on one side and the middle bend is clamped on an opposite side.

3 Claims, 8 Drawing Sheets

CROSSED TYPE DOUBLE-CLAMP CLIP

BACKGROUND OF THE INVENTION

A conventional clip for fastening sheets of paper together is generally made by bending an iron wire into pairs of legs and bends around a circle. FIG. 1 shows a clip of this type. This structure of clip is suitable for fastening few sheets of paper. When several sheets of paper are fastened together, as shown in FIGS. 2, 3, and 4, either bend of the clip may project, causing the sheets of paper to escape from the clip, or the clip may be forced to deform, causing a damage to the sheets of paper.

SUMMARY OF THE INVENTION

The present invention has been accomplished under the aforesaid circumstances. The present invention is made by bending an iron wire into shape, having two clamping portions symmetrically disposed below a middle bend thereof and crossed over each other. The clamping portions are made in the configuration of an open loop, either in a triangular or oblong shape. The relative positions of the two clamping portions will change according to the thickness of the stack of paper onto which the two clamping portions are to be clamped on one side and the middle bend is to be clamped on an opposite side. Therefore, the clip is practical for clamping paper of different thickness. When fastened to a stack of paper, the two clamping portions are maintained closely and smoothly attached to one side of the stack of paper, and therefore the clip does not damage the stack of paper. The clamping force of the clip is directly proportional to the thickness of the stack of paper (within a critical range). As the clip is made by bending an iron wire into shape, the production of the clip is easy and inexpensive, and no material will be wasted during the production of the clip.

DETAILED DESCRIPTION OF THE PREFERRED EMBODIMENT

Figure 1:
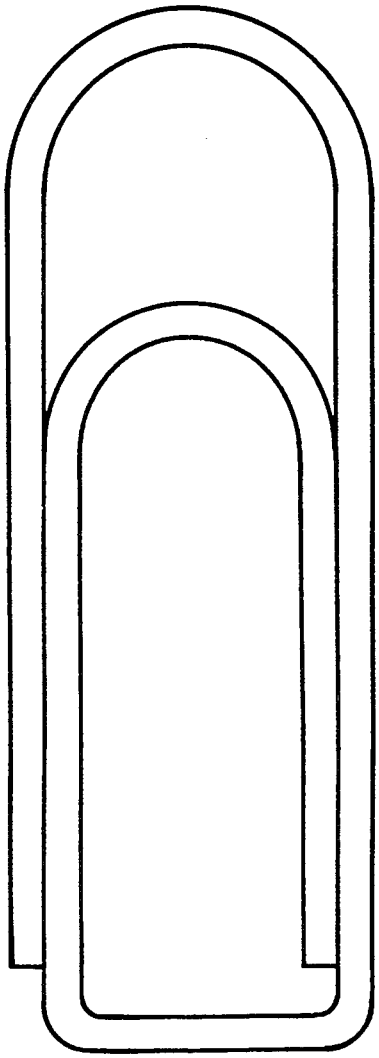
FIG. 1 PRIOR ART
FIG. 1 is a plain view of a prior art clip.
Figure 2:
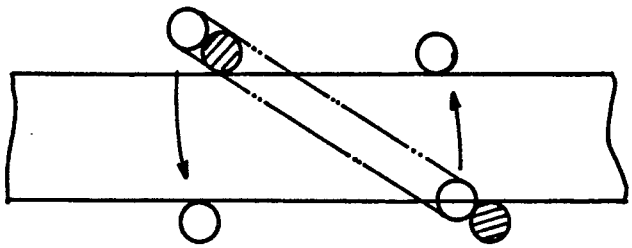
FIG.2 PRIOR ART
FIG. 2 is a sectional end view of the prior art clip fastened to a thick object.
Figure 3:
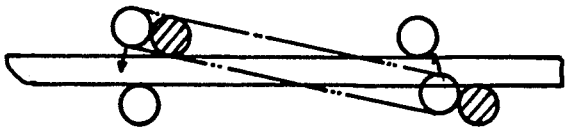
FIG.3 PRIOR ART
FIG. 3 is a sectional end view of the prior art clip fastened to a thinner stack of paper.
Figure 4:
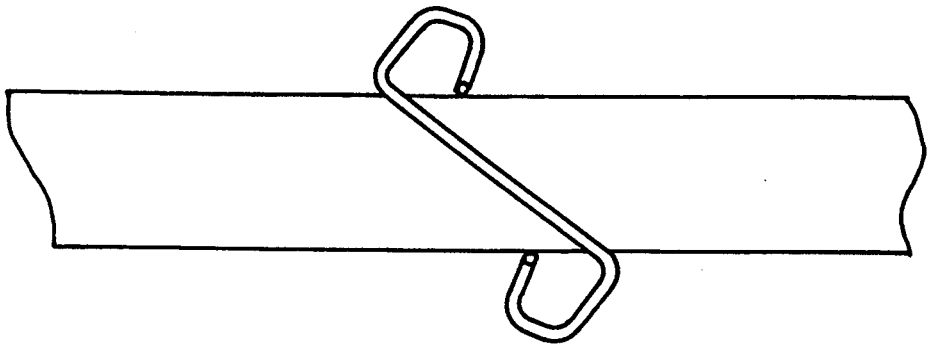
FIG.4 PRIOR ART
FIG. 4 illustrates the prior art clip deformed when fastened to a thick stack of paper.
Figure 5:
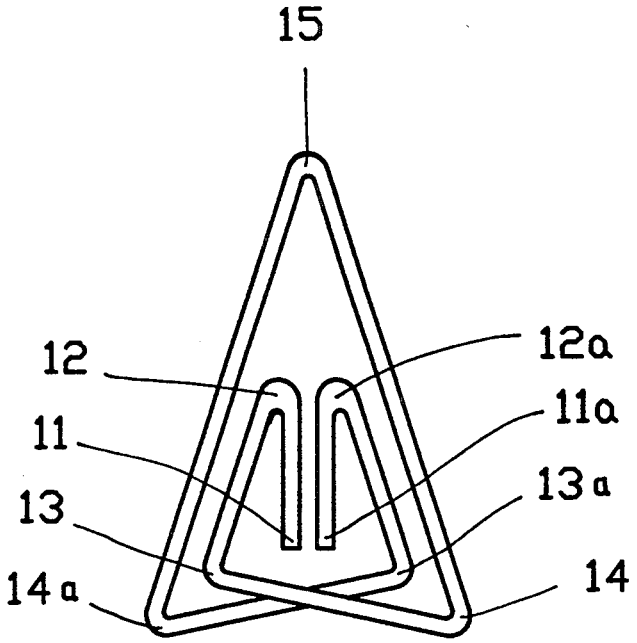
FIG. 5 illustrates the configuration of a crossed type double-clamp clip according to the preferred embodiment of the present invention.
Figure 6:
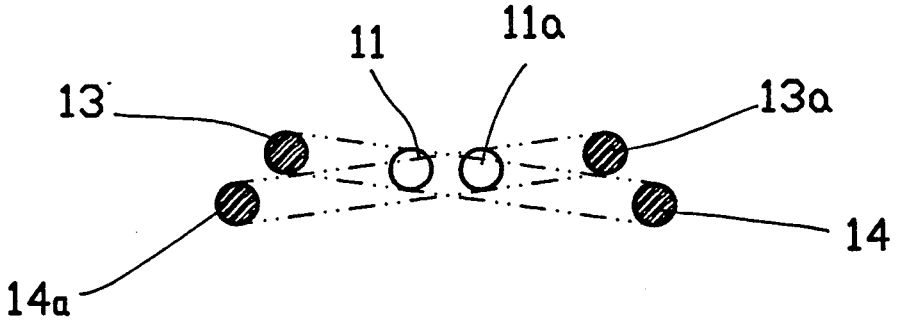
FIG. 6 is a sectional plain view of the clip of FIG. 5 viewed from one end.

Referring to FIGS. 5 and 6, a crossed type double-clamp clip according to the present invention is formed by bending an iron wire into shape, having two opposite ends formed into two open loops cross each other at the bottom. The crossed bottom of the clip is automatically adjusted open loops crossed at the bottom normal clip according to the thickness of the stack of paper fastened, so that the stack of paper is firmly held together.

Figure 7:
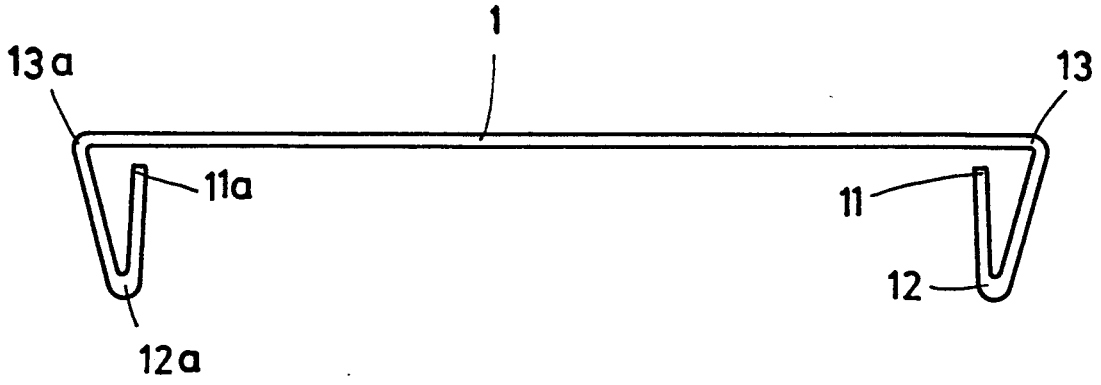
FIGS. 7, 8, and 9 are a series of drawings showing an iron wire bent into a crossed type double-clamp clip according to the present invention.
Figure 8:
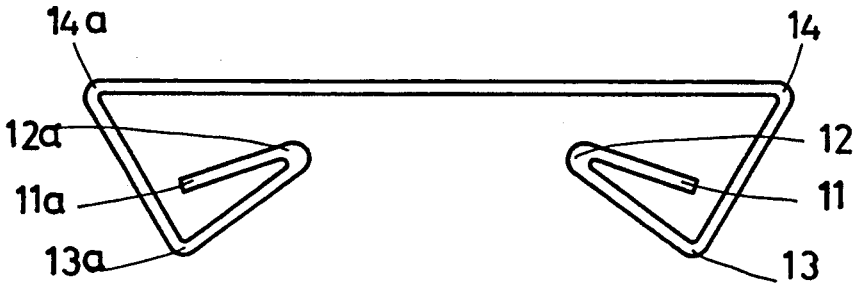
Figure 9:
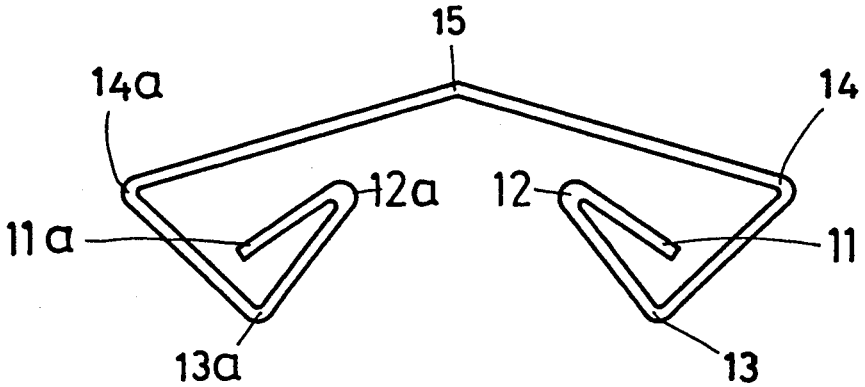

Referring to FIGS. 7, 8, and 9, and FIG. 5 again, the two opposite ends, namely, the first end 11 and second end 11*a* of an iron wire 1 are bent inwards to form two symmetrical bends, namely, the first bend 12 and the second bend 12*a*, then the iron wire 1 is bent inwards again to turn the first and second bends 12;12*a* inwards toward each other and to form a third bend 13 and a fourth bend 13*a* respectively spaced from the first and second bends 12;12*a*, and then the iron wire 1 is bent inwards again to turn the third and fourth bend 13;13*a* inwards toward each other and to form a fifth bend 14 and a six bend 14*a* respectively spaced from the third and fourth bends 12;13*a*, and then the iron wire 1 is bent inwards again to turn the fifth and six bends 14;14*a* inwards toward each other and to form a seventh bend 15 in the middle of the iron wire 1. When shape formed, the first end 11, first end 12, third bend 13, and fifth bend form into a first clamping portion arranged in the configuration of an open loop, and the second end 11*a*, second bend 12*a*, fourth bend 13*a*, and six bend 14*a* form into a second clamping portion arranged in the configuration of an open loop. The first clamping portion and the second clamping portion are symmetrically disposed below the seventh bend 15 and crossed over each other.

Figure 10:
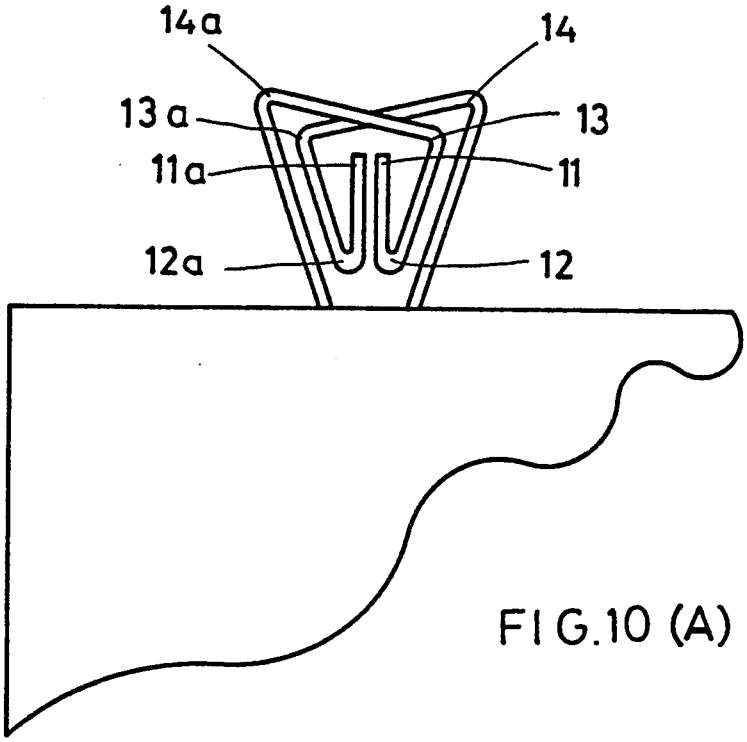
FIG. 10 is a series of drawings showing a crossed type double-clamp clip fastened to a stack of paper.
Figure 10:
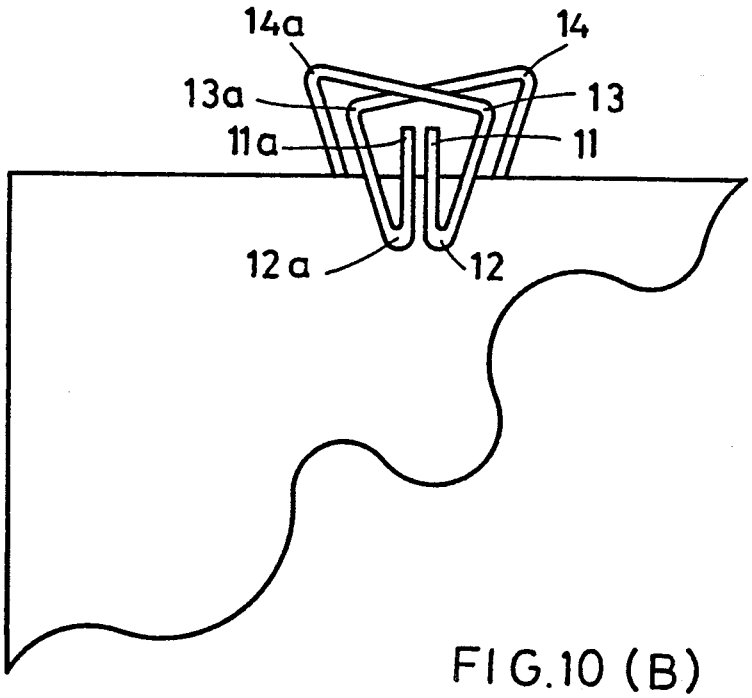
Figure 10C:
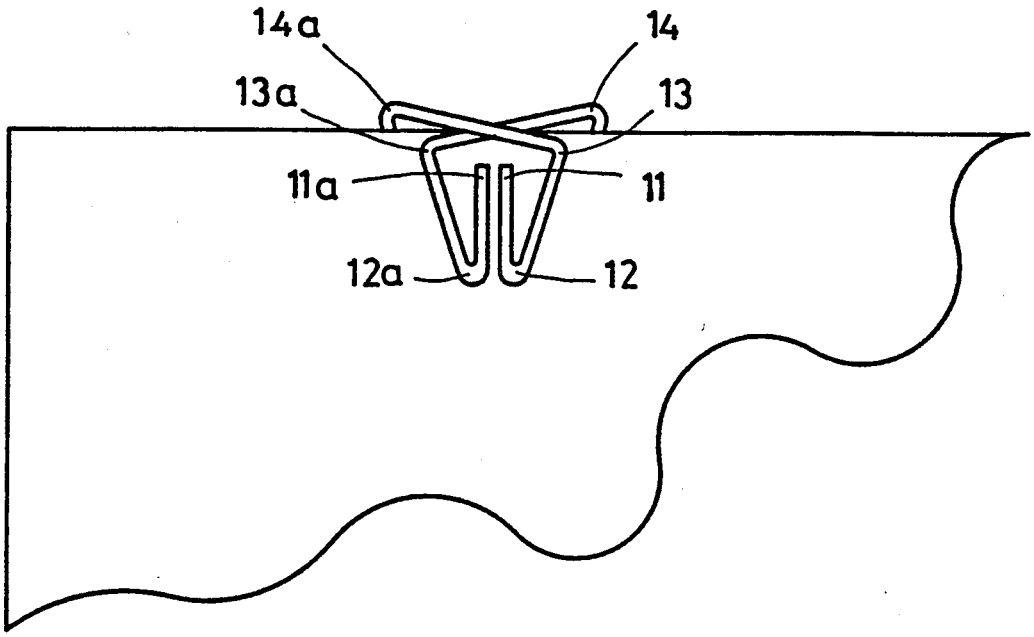
Figure 10:
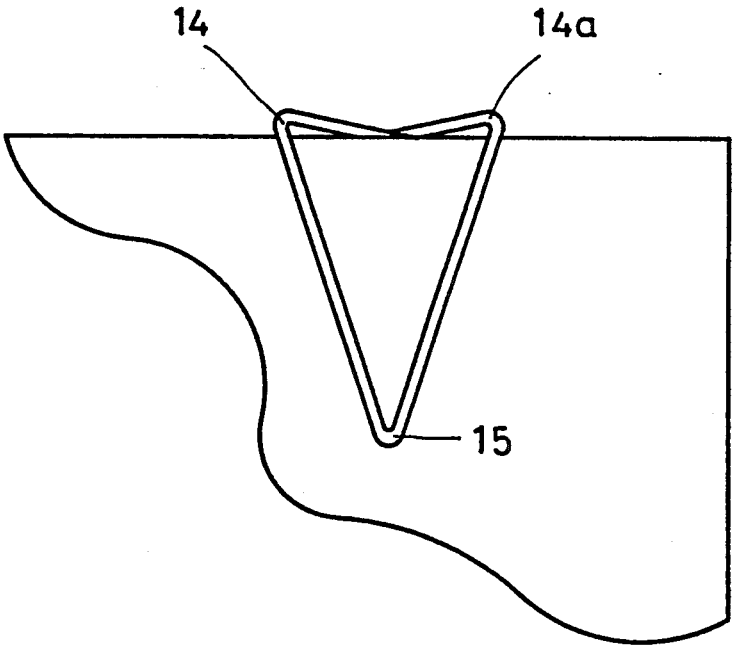
Figure 11:
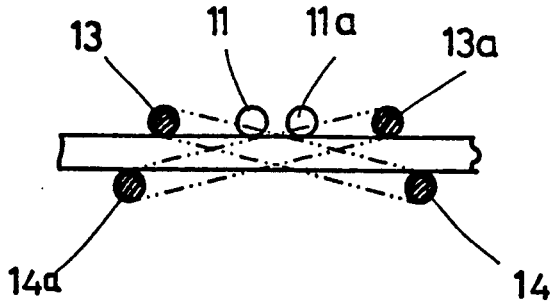
FIG. 11 are end views showing the crossed type double-clamp clip respectively fastened to stacks of paper of different thickness.
Figure 11:
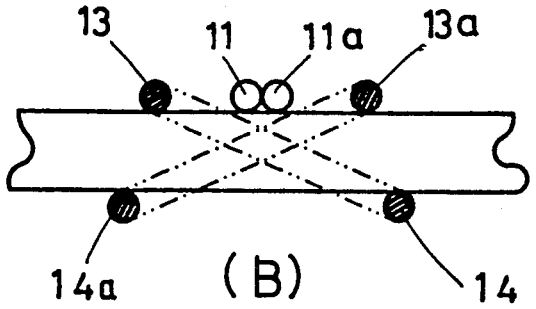
Figure 12:
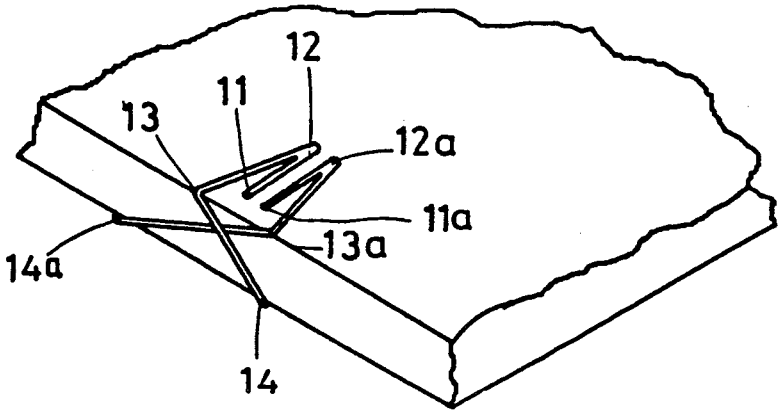
FIG. 12 is an elevational view showing the crossed type double-clamp clip fastened to a stack of paper.

Referring to FIGS. 10, 11, and 12, as the clip is fastened to a stack of paper, the seventh bend 15 is clamped on one side of the stack of paper; the first and second clamping portions are clamped on an opposite side of the stack of paper; the fifth and six bends 14;14*a* and the third and fourth bends 13;13*a* are respectively clamped on the edges of the two opposite sides of the stack of paper. When a thicker stack of paper is fastened, the distance between the third and fourth bends 13;13*a* is relatively reduced, and the pitch between the fifth and six bends 14;14*a* and the third and fourth bends 13;13*a* is relatively increased, and therefore the first and second clamping portions are maintained closely clamped on the stack of paper. Therefore, the crossed type double-clamp clip can be automatically adjusted to change the relative positions of the first and second clamping portions thereof according to the thickness of the stack of paper fastened.

While only one embodiment of the present invention has been shown and described, it will be understood that various modifications and changes could be made without departing from the spirit and scope of the invention. For example, the first and second clamping portions may be respectively made in the shape of a triangular or oblong configuration.

What is claimed is:

1. A crossed type double-clamp clip made by bending an iron wire to turn two opposite ends thereof inwards to form a first bend and a second bend respectively spaced from said two opposite ends, then bending the iron wire inwards again to turn said first and second bends inwards toward each other and to form a third bend and a fourth bend respectively spaced from said first and second bends, then bending the iron wire inwards again to turn said third and fourth bends inwards toward each other and to form a fifth bend and a six bend respectively spaced from said third and fourth bend, and then bending the iron wire inwards again to turn said fifth and six bends inwards toward each other and to form a seventh bend in the middle of the iron wire, one end of the iron wire and said first, third, and fifth bends forming into a first clamping portion arranged in the configuration of an open loop, the other end of the iron wire and said second, fourth, and six bends forming into a second clamping portion arranged in the configuration of an open loop, said first and second clamping portions being symmetrically disposed below said seventh bend and crossed over each other, said first and second clamping portions being clamped on one side of an object, said fifth bend being clamped on an opposite side of said object.

2. The crossed type double-clamp clip of claim 1 wherein said first and second clamping portions are respectively made in the shape of a triangular open loop.

3. The crossed type double-clamp clip of claim 1 wherein said first and second clamping portions are respectively made in the shape of an oblong open loop.

* * * * *